US006211823B1

(12) United States Patent
Herring

(10) Patent No.: US 6,211,823 B1
(45) Date of Patent: Apr. 3, 2001

(54) LEFT-HAND CIRCULAR POLARIZED ANTENNA FOR USE WITH GPS SYSTEMS

(75) Inventor: Russell M. Herring, San Antonio, TX (US)

(73) Assignee: ATX Research, Inc., San Antonio, TX (US)

( * ) Notice: Subject to any disclaimer, the term of this patent is extended or adjusted under 35 U.S.C. 154(b) by 0 days.

(21) Appl. No.: 09/234,566

(22) Filed: Jan. 20, 1999

Related U.S. Application Data

(60) Provisional application No. 60/083,192, filed on Apr. 27, 1998.

(51) Int. Cl.[7] ..... H01Q 1/38; H01Q 1/32

(52) U.S. Cl. ..... 343/700 MS; 343/713; 343/797

(58) Field of Search ..... 343/700 MS, 711, 343/712, 713, 797; H01Q 1/38, 1/32

(56) References Cited

U.S. PATENT DOCUMENTS

| | | | | |
|---|---|---|---|---|
| 3,906,514 | | 9/1975 | Phelan | 343/895 |
| 3,956,752 | | 5/1976 | Phelan et al. | 343/754 |
| 4,486,758 | * | 12/1984 | De Ronde | 343/700 MS |
| 4,845,506 | | 7/1989 | Shibata et al. | 343/713 |
| 4,887,090 | * | 12/1989 | Shibano et al. | 343/711 |
| 4,893,129 | | 1/1990 | Kodera et al. | 343/700 |
| 4,959,657 | | 9/1990 | Mochizuki | 343/725 |
| 4,968,984 | | 11/1990 | Katoh et al. | 343/713 |
| 5,003,318 | * | 3/1991 | Berneking et al. | 343/700 MS |
| 5,128,755 | | 7/1992 | Fancher | 358/108 |
| 5,212,494 | | 5/1993 | Hofer et al. | 343/859 |
| 5,298,908 | | 3/1994 | Piele | 342/363 |
| 5,995,044 | * | 11/1999 | Kunysz et al. | 342/363 |

OTHER PUBLICATIONS

Author: Unknown, Date: Unknown, Antenna Systems for Space Communications, "Circular Polarization", Ch. 19, pp. 19–9, 19–10.

Amateur Radio Relay League, 1997, ARRL Handbook for Radio Amateurs, "Repeaters, Satellites, EME and Direction Finding", Ch. 23, pp. 23.36, 23.37.

* cited by examiner

*Primary Examiner*—Hoanganh Le
(74) *Attorney, Agent, or Firm*—Jenkens & Gilchrist

(57) ABSTRACT

An antenna system, comprising a left-hand circular polarized antenna, is disclosed for use in receiving signals from a GPS location satellite which are originally-transmitted as RHCP signals. Reception occurs after the right-hand circular polarized signal is reflected, or bounces off of, a surface one or more times. The number of reflections must be an odd number. The left-hand circular polarized antenna may be mounted underneath a vehicle or a building overhang. The method of the invention comprises the steps of transmitting a right-hand circular polarized signal and receiving the signal using a left-hand circular polarized antenna placed in a location where the right-hand circular polarized signal must be reflected by an odd number of surfaces before reception.

20 Claims, 4 Drawing Sheets

LEFT-HAND CIRCULAR POLARIZED ANTENNA FOR USE WITH GPS SYSTEMS

This application claims the benefit under Title 35 United States Code §119(e) of U.S. Provisional Application No. 60/083,192, filed Apr. 27, 1998.

BACKGROUND OF THE INVENTION

1. Technical Field

The present invention pertains to an antenna; more particularly the present invention pertains to a left-hand circular polarized GPS antenna used to receive space-based satellite GPS signals after reflecting off of a surface an odd number of times.

2. History of Related Art

Polarization is a description of how the direction of the electric field vector changes within an electromagnetic wave at a fixed point in space over time. If the wave is propagating in the positive z-direction, the electric field vector at a fixed point, for example at z=0.0, can be expressed in the following general form:

$$E_{z=0,t}=\delta_x E_o \cos(\omega t)+\delta_y A E_o \cos(\omega t+\phi)$$

Mathematically, linear and circular polarization are special cases of elliptical polarization. Consider two electric-field vectors at right angles to each other propogating in the same direction. The frequencies are the same, but the magnitudes and face angles vary. If either one or the other of the magnitudes is zero, linear polarization results. If the magnitudes are the same and the phase angle between the two vectors (in time) is 90 degrees, circular polarization results. Of course, any combination between these two limits gives elliptical polarization.

The ideal antenna for use with random polarization is one with a circularly polarized radiation pattern. Polarization sense is a critical factor, especially when satellites are used to propagate signals, since the receiving antenna must be of the same polarity as the transmitting antenna for proper reception. In the case of GPS satellites, the most common transmitted signal is the right hand circular polarized signal. This occurs when the values for the general equation above include A=1 and $\phi=-\pi/2$, thus:

$$E_{z=0,t}=\delta_x E_o \cos(\omega t)+\delta_y E_o \cos(\omega t-\pi/2)$$

The x and y components of the electrical field in this case have the same magnitude, and oscillate 90 degrees out of phase.

The signal emanating from the space-based satellite GPS system is right-hand circular polarized, and is intended to be received by a Right-Hand Circular Polarized (RHCP) antenna. However, optimal reception of a RHCP signal by a RHCP antenna requires that the antenna be in direct line-of-sight with the satellite. If the RHCP signal reflects off of a surface before striking the antenna, the polarity will be reversed (to Left-Hand Circular Polarized (LHCP)) with an attendant loss of signal strength.

The characteristic equation for a Left-Hand Circularly Polarized signal results when A=1 and $\phi=\pi/2$, thus:

$$E_{z=0,t}=\delta_x E_o \cos(wt)+\delta_y E_o \cos(\omega t+\pi/2).$$

Thus, the LHCP signal is 180 degrees out of phase with the RHCP signal, which gives at least a 3.0 dB signal loss in practice. If the receiver is sensitive, this may not be a problem. However, for many applications, it is desirable to reduce the amount of receiver sensitivity needed so as to enhance the signal-to-noise ratio. Further, a less sensitive receiver is less expensive to manufacture. Also, many applications utilizing GPS technology simply cannot physically locate the receiving antenna such that a direct line-of-sight with the satellite transmitting the RHCP signal is possible.

Since some applications utilizing GPS technology must position the receiving antenna such that signal reflection is necessary, an antenna is needed which can make the best use of a reflected signal. In addition, a method of using the antenna to best make use of such a reflected RHCP signal is needed.

SUMMARY OF THE INVENTION

An antenna system, comprising a left-hand circular polarized antenna, is disclosed for use in receiving signals from a GPS location satellite which are originally-transmitted as RHCP signals. Reception occurs after the right-hand circular polarized signal is reflected, or bounces off of, a surface one or more times. The number of reflections must be an odd number. The left-hand circular polarized antenna may be mounted underneath a vehicle or a building overhang. The method of the invention comprises the steps of transmitting a right-hand circular polarized signal and receiving the signal using a left-hand circular polarized antenna placed in a location where the right-hand circular polarized signal must be reflected by an odd number of surfaces before reception.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1A:
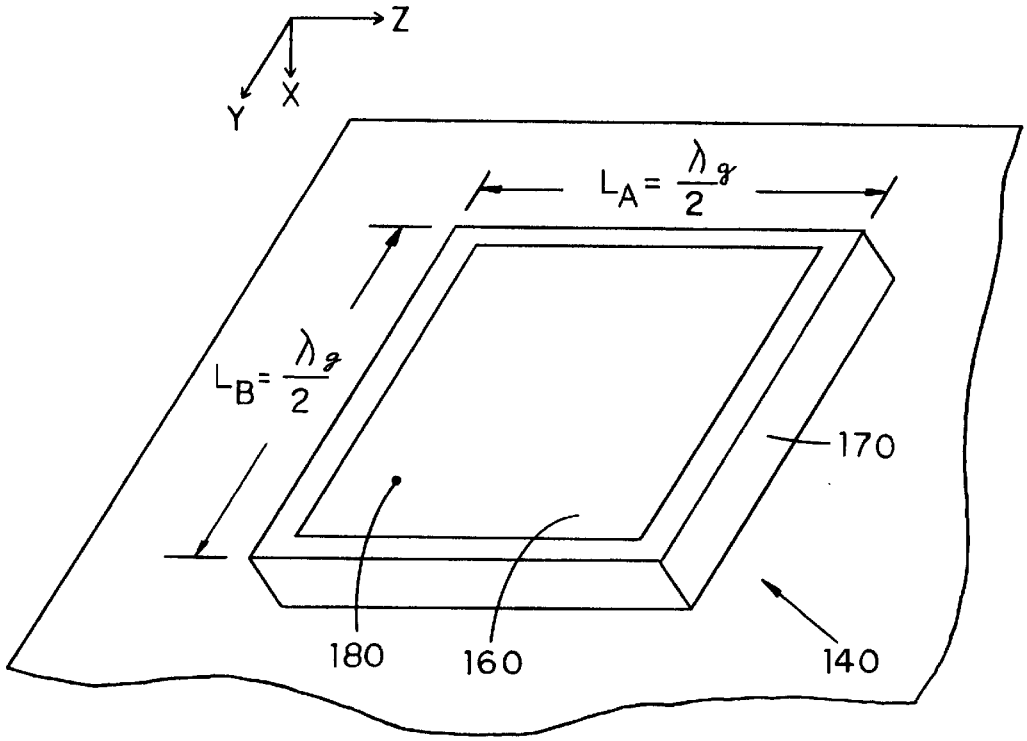
FIGS. 1A, 1B, and 1C illustrate perspective views of a LHCP patch antenna, feedline-phased dipole antennas, and spatially-phased dipole antennas of the present invention, respectively.

Circular polarization (CP) is a special case of elliptical polarization (EP). This is also the case with linear polarization (LP), wherein the general equation for a propagating wave is modified to encompass an LP signal whenever A=0, or A≠0 and $\phi=0$ so that:

$$E_{z=0,t}=\delta_x E_o \cos(\omega t);$$

or $$E_{z=0,t}=\delta_x E_o \cos(\omega t)+A\delta_y E_o \cos(\omega t).$$

Theoretically a RHCP antenna cannot receive a LHCP signal, since the signals are 180° out of phase. In practice however, such reception is possible. Since circular polarization is created by two orthogonal linear wave elements operating 90° out of phase, each element contributes half of the signal needed to produce a circularly polarized (CP) wave via superposition. Therefore, a linearly polarized antenna can receive half of the CP wave energy (regardless of whether the wave is RHCP or LHCP), which equates to a power loss of 3 dB.

Since a Circularly Polarized (CP) electromagnetic wave is produced when an antenna provides equal amplitude signals that are spatially orthogonal, differing in phase by ±90°, there are several methods which can be used to excite circular polarization, including variations in feedline phasing, spatial phasing, and construction of a rectangular patch antenna.

When feedline phasing is used, a pair of dipole antenna elements located in the XY plane each contribute a linear polarized signal in the X and Y planes. A quarter-wavelength feedline section is used to join each of the dipole elements to the main feedline; the result is a linear wave in one plane which leads the linear wave in the other plane by one-quarter wavelength, or 90°.

Spatial phasing involves feeding each dipole element with the same signal (i.e., both elements in-phase), but the physical elements are physically located one-quarter wavelength apart. A signal originating at the leading element will be followed by a similar signal from the trailing element, separated in space by one-quarter wavelength, or 90°. Again, two signals of equal amplitude are propagated with a 90° phase difference, producing circular polarization.

Rectangular microstrip patch antennas are also commonly used as the basis for a circularly polarized antenna element. These antennas are inexpensive, rugged, and small when compared to other types of antenna elements commonly available. This tends to increased their popularity for use with GPS satellite signal reception.

The patch antenna embodies slot radiators located between the printed circuit element and the ground plane. Each slot is approximately one-half "wavelength" long, wherein the "wavelength" is shorter than the free-space wavelength by a factor ordered according to the dielectric constant of the material physically located between the printed circuit element and the ground plane.

A slot radiator propagates the same wave pattern as a dipole of the same electrical length. Since a rectangular patch embodies four slots, one at each end of the patch, the slots opposite each other operate in-phase, and act as a slot pair.

If the receiving antenna is left-hand circular polarized as opposed to right-hand circular polarized, then the output from this receiving antenna would be greatest with a signal which has been reflected off of a surface before striking the antenna. In fact, the signal will be greater after reflecting off of surfaces an odd number of times. This allows placement of the antenna underneath vehicles or over-hangs which prevent direct line of sight with the signal transmitting satellite.

The purity of a CP wave is described by the term "axial ratio," which is the ratio of the lengths of the major and minor axes within the EP wave. For a CP wave, the axial ratio is 1, or 0.0 dB. For an LP wave, the axial ratio is infinite.

Commonly available CP antennas are designed to produce an axial ratio of 0.0 dB. However, a 0.0 dB axial ratio cannot be maintained over the entire radiation pattern of the antenna. In the case of a patch antenna, the axial ratio will be 0.0 dB broadside to the patch, while large axial ratios will exist in the plane of the patch. The implication is that perfect CP is available only over a very small beamwidth, and polarization becomes elliptical at any other location.

The more elliptical a wave's polarization becomes, the more it behaves in a linear fashion. Due to superposition, an LP antenna will receive half of an available ellipsical signal, so an EP (quasi-linear) antenna will receive less than half the available signal, if the transmit and receive antennas are of opposite CP. This is what allows a LHCP antenna to receive a RHCP wave directly, but with a signal loss of at least 3.0 dB. In the case of a LHCP patch antenna, reception of a RHCP satellite signal directly overhead will suffer severe signal loss because the axial ratio will be near 0 dB. The best reception is obtained from a satellite on the horizon, at lower elevations, where the antenna polarization becomes more elliptical.

However, once the signal has reflected off of a surface, so that a signal that originated as a RHCP signal is transformed into a LHCP signal, to be received by a LHCP antenna, the situation is improved considerably. The advantage of using a like-handed CP antenna to receive a like-handed CP wave is that the worst case axial ratio allows the antenna to receive at least half the available signal. Any other case will show some gain over this worst case, a gain that may be up to 3 dB. Empirical testing has led to the discovery that using an LHCP antenna to receive a reflected RHCP signal (when only the reflected signal was available) provided consistently better performance (i.e., higher signal-to-noise ratio) than using an RHCP antenna under the same conditions.

Figure 1B:
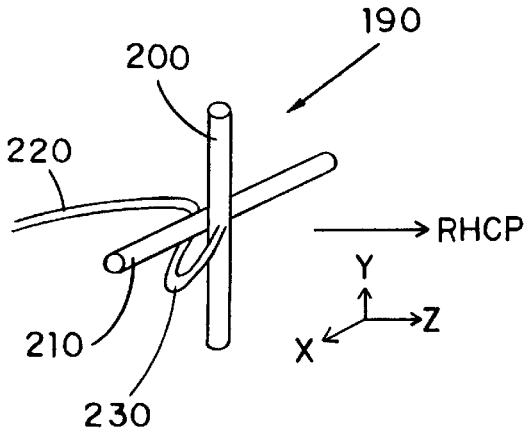
Figure 1C:
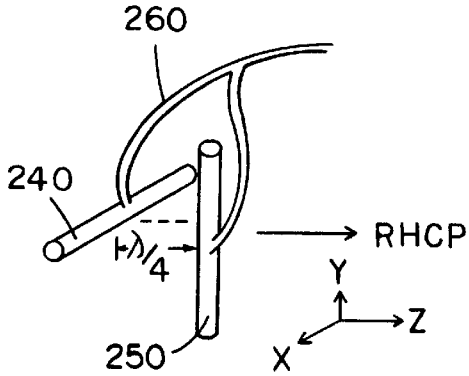

FIGS. 1A, 1B and 1C illustrate various types of antennas which may be used as the LHCP antenna of the present invention. In FIG. 1A, a rectangular patch antenna 140 is illustrated. The patch antenna 140 is constructed of a printed circuit element 160 spaced apart from a ground plane 150 using a dielectric element 170. Typically, each side of the wafer is sized according to the free space wavelength of the antenna, as modified by the effective dielectric constant of the spacing material or dielectric element 170. A feedpoint 180 is located on the surface of the printed circuit element according to whether the phase difference in the antenna 140 is produced by corrupting the patch element, or detuning the patch element. The formulae for constructing such an antenna 140 are well known in the art, and can be seen by referring to the text *Microwave Engineering* as authored by David M. Pozar and published by Addison Wesley in 1993. When the antenna 140 is constructed so that the length $L_A$ is slightly greater than $L_B$, the polarization of the antenna is LHCP in the x-direction.

As discussed previously, a pair of phased dipoles can also be used to construct a LHCP antenna. Two different types of phased dipoles are illustrated in FIGS. 1B and 1C. FIG. 1B illustrates a feedline-phased LHCP antenna 190, which is constructed from a pair of dipole elements, the lagging element 200 and the leading element 210. The elements are excited by a feedline 220 which is connected directly to the leading element 210 at its center, and then to the lagging element 200 at its center by an additional length of feedline measuring one-quarter wavelength. As shown in FIG. 1B, the RHCP wave propagates in the z-direction when the dipole elements are arrayed in the x-and-y plane directions.

FIG. 1C illustrates a spatially-phased pair of dipole elements, wherein the LHCP antenna of the present invention is constructed by feeding the leading element 250 at its center with the same signal that is fed to the lagging element 240 at its center, using the feedline 260. In this case, the feedline presents the same signal to each element, but the elements are separated by a physical distance of one-quarter wavelength. The RHCP wave propagates in the z-direction when the dipole elements are arrayed in the x- and y-plane directions.

Figure 2:
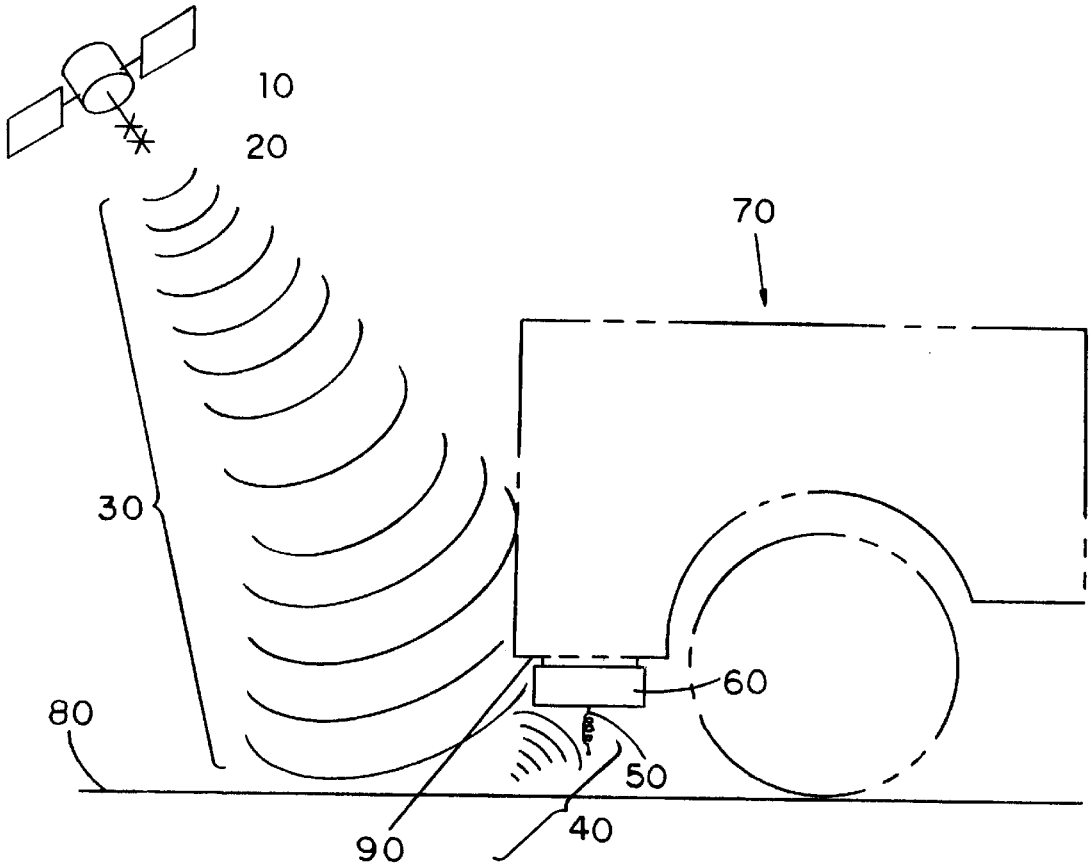
FIG. 2 is a simplified diagram illustrating physical location of the antenna system of the present invention.

Referring now to FIG. 2, a vehicle equipped for receiving a RHCP signal from a satellite can be seen. The vehicle 70 is shown traveling over a reflecting surface 80. The vehicle 70 comprises a LHCP antenna 50 which is attached to a surface facing away from the satellite signal line-of-sight, or underside 90 of the vehicle 70. Typically, this attachment occurs by means of a GPS location signal receiver circuit enclosure 60, but may also occur by way of direct attachment between the antenna 50 and the underside 90 of the vehicle 70.

The LHCP antenna 50 is attached to the surface 90 so as to receive a RHCP signal 30, which may be a GPS location signal, from the satellite 10, as transmitted from a RHCP antenna 20. The signal 30 will bounce an odd number of times before reception by the antenna 50. Of course, the greatest signal gain will occur if the signal 30 bounces only a single time from the reflecting surface 80 before reception by the antenna 50. The antenna 50 may comprise a rectangular patch antenna as illustrated in FIG. 1A.

Essentially, the antenna system of the present invention for receiving a non-line-of-sight GPS location signal comprises a LHCP antenna which receives the non-line-of-sight GPS location signal after the signal is reflected from an odd number of surfaces, typically one. That is, the LHCP antenna receives an RHCP signal after the RHCP signal is transformed into an LHCP signal by reflection from an odd number of surfaces. The greatest signal strength will occur when the RHCP signal has been reflected a single time from the reflecting surface 80 to the LHCP antenna 50. The LHCP antenna may also comprise a pair of phased dipole antennas, as are illustrated in FIGS. 1B and 1C.

Figure 3:
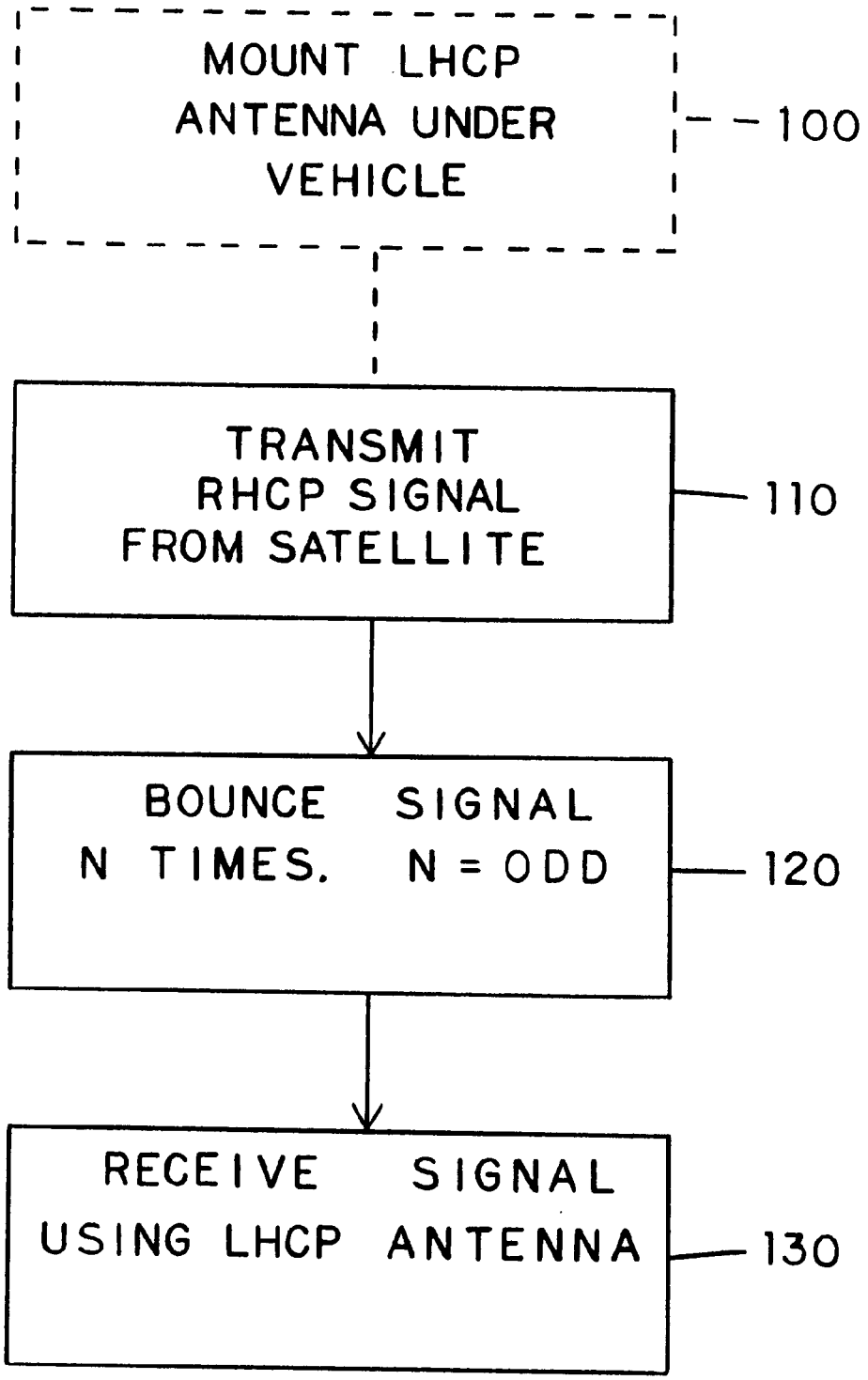
FIG. 3 is a flow chart diagram of the method of the present invention.

The method of the present invention for obtaining a GPS location signal can be found in FIG. 3. The method includes the steps of mounting an LHCP antenna under a vehicle or building overhang in step 100, transmitting a RHCP signal from a satellite in step 110, bouncing the transmitted signal n times, where n is an odd number in step 120, and then receiving the signal using an LHCP in step 130. Step 100 is optional; the LHCP antenna can be attached in many different locations, one of which is the underside of a vehicle. Alternatively, the method for obtaining a GPS location signal as disclosed herein can be described as comprising the steps of transmitting a RHCP GPS location signal from an orbiting satellite, and receiving the RHCP GPS location signal with a LHCP antenna by placing the LHCP antenna in a location where the RHCP GPS location signal must be reflected by an odd number of surfaces before being received by the LHCP antenna.

The method includes circumstances where the attachment location of the LHCP antenna is underneath a vehicle or a building overhang. The method also includes circumstances wherein the odd number of surfaces includes a single surface, which may be the surface over which the vehicle travels. The LHCP antenna may comprise a rectangular patch antenna or a pair of phased dipole antennas, as are illustrated in FIGS. 1A, 1B, and 1C.

Figure 4:
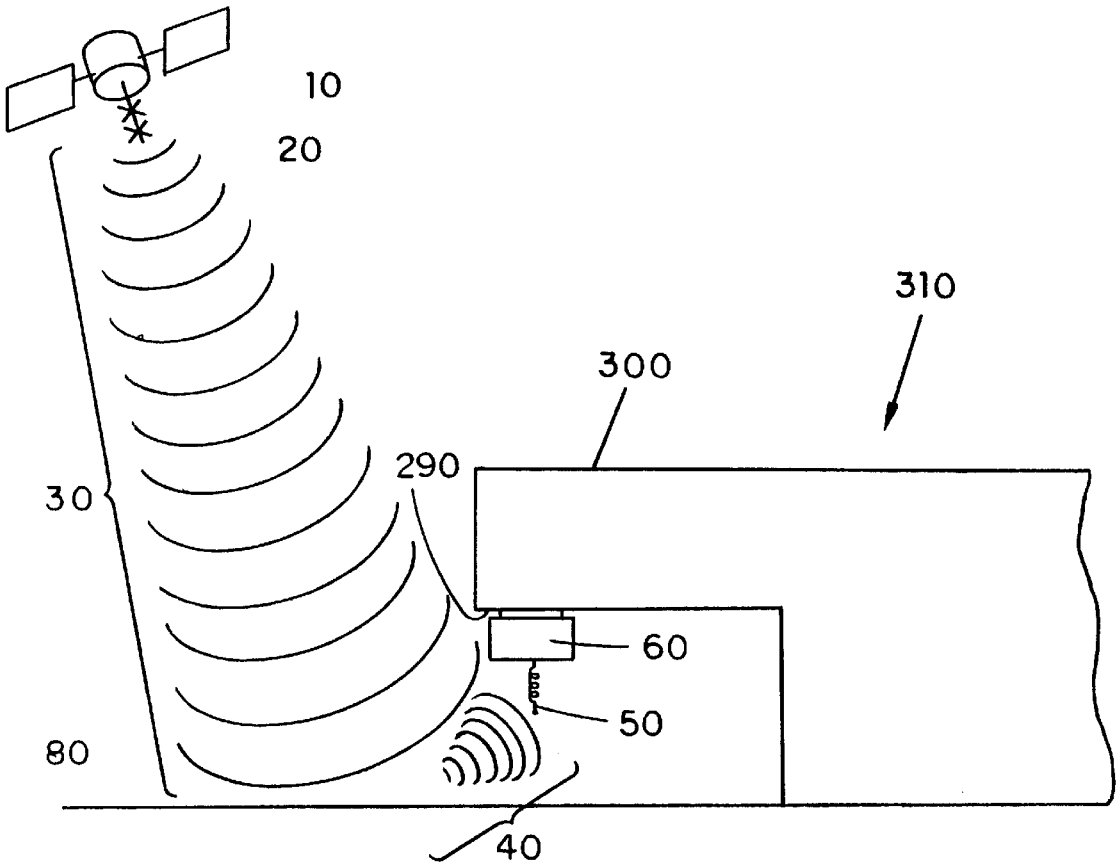
FIG. 4 is a perspective view of the antenna system of the present invention illustrating use under a building overhang.

Turning now to FIG. 4, the antenna system of the present invention as used under a building 310 overhang 300 is shown. In this case, the non-line-of-sight signal, or LHCP signal 40, is received by the LHCP antenna after being reflected from a surface 80. As discussed above, the satellite 10 originally propagates a RHCP signal 30 from an RHCP antenna 20. Also, the antenna 50 may be attached directly to the underside 290 of the overhang 300, or by way of a GPS location signal receiver circuitry enclosure 60.

Although the invention has been described with reference to specific embodiments and methods, this description is not meant to be construed in a limited sense. The various modifications of the disclosed embodiments and methods, as well as alternative embodiments and methods of the invention, will become apparent to persons skilled in the art upon reference to the description of the invention. It is, therefore, contemplated that the appended claims will cover such modifications that fall within the scope of the invention, or their equivalents.

I claim:

1. An antenna system, comprising:

a left-hand circular polarized antenna for receiving a non-line of sight satellite GPS location signal; and a surface, wherein the non-line of sight satellite GPS location signal is reflected from the surface.

2. The antenna system of claim 1, wherein the left-hand circular polarized antenna receives the non-line-of-sight GPS location signal after the signal is reflected from an odd number of surfaces.

3. The antenna system of claim 1, wherein the antenna receives a right-hand circular polarized signal after the right-hand circular polarized signal is transformed into a left-hand circular polarized signal.

4. The antenna system of claim 3, wherein the right-hand circular polarized signal is transformed into a left-hand circular polarized signal by reflection from an odd number of surfaces.

5. The antenna system of claim 1, wherein the antenna is mounted underneath a vehicle.

6. The antenna system of claim 5, wherein the surface is a surface over which the vehicle travels.

7. The antenna system of claim 6, wherein the non-line-of-sight signal is a left-hand circular polarized signal that has been reflected from the surface directly to the antenna one time after transmission from a satellite.

8. The antenna system of claim 6, wherein the non-line-of-sight signal is a left-hand circular polarized signal that has been reflected from the surface directly to the antenna one time after transmission as a right-hand circular polarized signal.

9. The antenna system of claim 1, wherein the left-hand circular polarized antenna comprises a rectangular patch antenna.

10. The antenna system of claim 1, wherein the left-hand circular polarized antenna comprises a pair of phased dipole antennas.

11. A method for obtaining a GPS location signal, said method comprising the steps of:

transmitting a right-hand circular polarized GPS location signal from an orbiting satellite; and receiving said right-hand circular polarized GPS location signal with a left-hand circular polarized antenna by placing said left-hand circular polarized antenna in a location where said right-hand circular polarized GPS location signal must be reflected by an odd number of surfaces before being received by said left-hand circular polarized antenna.

12. The method of claim 11, wherein the location is underneath a vehicle.

13. The method of claim 12, wherein the odd number of surfaces is a single surface over which the vehicle travels.

14. The method of claim 11, wherein the location is underneath a building overhang.

15. The method of claim 11, wherein the left-hand circular polarized antenna comprises a rectangular patch antenna.

16. The method of claim 11, wherein the left-hand circular polarized antenna comprises a pair of phased dipole antennas.

17. A vehicle equipped for receiving a satellite right-hand circular polarized signal, said vehicle comprising:

a left-hand circular polarized antenna; and a surface facing away from the satellite right-hand circular polarized signal line-of-sight, said antenna being attached to said surface so as to receive the satellite right-hand circular polarized signal as a left-hand circular polarized signal.

18. The vehicle of claim 17, wherein the right-hand circular polarized signal bounces an odd number of times before reception by the antenna.

19. The vehicle of claim 18, wherein the odd number is one.

20. The vehicle of claim 17, wherein the antenna comprises a rectangular patch antenna.

* * * * *